United States Patent [19]

Swartz

[11] Patent Number: 4,716,902

[45] Date of Patent: Jan. 5, 1988

[54] ILLUMINATED PACIFIER

[76] Inventor: Barry E. Swartz, 8070 Pimlico La., Boerne, Tex. 78006

[21] Appl. No.: 898,188

[22] Filed: Aug. 20, 1986

[51] Int. Cl.[4] ..... A61J 17/00

[52] U.S. Cl. ..... 128/360; 362/800

[58] Field of Search ..... 128/359, 360, 23; 362/32, 800, 189, 205

[56] References Cited

U.S. PATENT DOCUMENTS 3,186,411 6/1965 Skidmore ..... 128/360

4,210,953 7/1980 Stone ..... 362/189

4,228,484 10/1980 Johnstone ..... 362/800

4,231,077 10/1980 Joyce et al. ..... 362/32

*Primary Examiner*—Dalton L. Truluck

*Assistant Examiner*—Denise Whelton

*Attorney, Agent, or Firm*—Gunn, Lee & Jackson

[57] ABSTRACT

A pacifier is disclosed having a light emitting diode whereby the pacifier may be located in the dark. The pacifier is also equipped with an internal light bulb, activated by squeezing the handle, so that the pacifier may be used as a flashlight in order to position it properly in a baby's mouth.

3 Claims, 2 Drawing Figures

ILLUMINATED PACIFIER

BACKGROUND OF THE INVENTION

1. Field of the Invention

The present invention relates to a pacifier for a baby to suckle on, and more particularly to a pacifier with an internal lighting mechanism.

2. Description of the Prior Art

In the past, many various types of instruments have been used in the field of pediatrics to calm small children and give them a feeling of security. These devices have acquired the common term pacifiers, and are well known not only for their tranquilizing effect, but also for their therapeutic advantages in that they massage the gums of a child and thereby assist in the cutting of teeth.

Pacifiers for babies are well known. Most consist of three parts: a nipple, a mouth template, and a handle. All three pieces are generally constructed of plastic or rubber.

Many varieties of pacifiers exist. Some have specially shaped nipples, for example, orthodontic flat nipples. The handle may be made of special material to serve as a teething ring. One pacifier has a thermometer device therein to serve as a temperature indicator.

As any parent can appreciate, it can be very difficult calming a crying baby in the middle of the night. One of the most common ways to placate the child is to give it a pacifier. However, the pacifier is usually given to the baby when it is first put to bed, and often gets lost in the sheets. The room is so dark that neither the child nor the parent can locate the pacifier. If the light is turned on, the infant in many cases completely wakes up and proceeds to become aggravated, and it takes even longer to soothe him to get him back to sleep. Furthermore, even if the pacifier is found in the dark, it is not an easy task to insert it into the baby's mouth.

It would therefore be desirous and advantageous to devise a pacifier which can easily be found in the dark, and which additionally serves as a flashlight to locate the child's mouth. The pacifier of the present invention overcomes the aforesaid disadvantages caused by the necessary circumstances of childhood.

SUMMARY OF THE INVENTION

Accordingly, the primary object of the present invention is to provide a pacifier which can easily be located in the dark.

Another object of the invention is to provide such a pacifier which can also function as a flashlight.

Still another object of the invention is to provide such a pacifier that would not create any danger to the baby.

Yet another object of the invention is to provide means whereby the energy source of the illumination is not quickly drained.

The foregoing objects are achieved in an illuminated pacifier having a low power light-emitting diode, a high power light bulb, and a light conducting plastic rod located in the handle thereof, being activated by squeezing the handle.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of illustrative embodiments when read in conjunction with the accompanying drawings, wherein:

DESCRIPTION OF THE PREFERRED EMBODIMENTS

Figure 1:
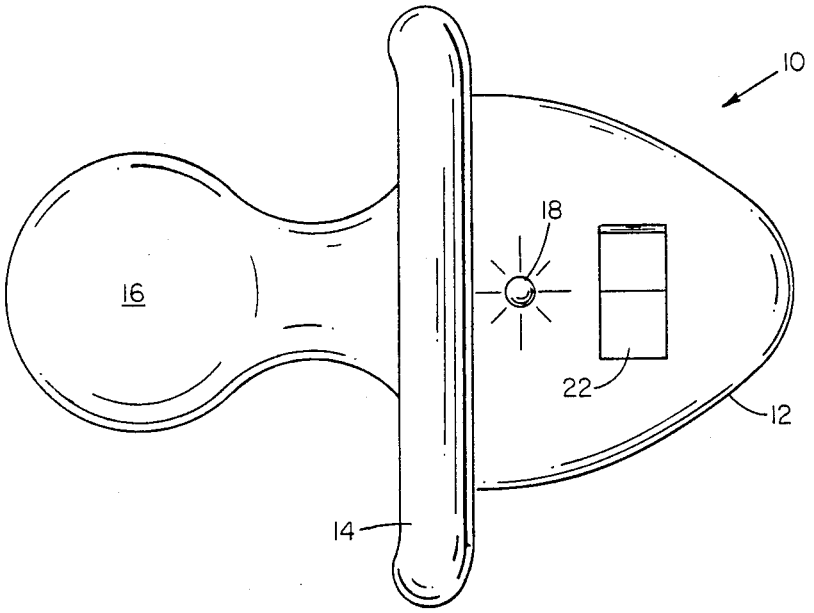
FIG. 1 is a top view of the illuminated pacifier of the present invention.

With reference now to the figures, and in particular with reference to FIG. 1, there is depicted a top view of the illuminated pacifier 10 of the present invention. Illuminated pacifier 10 is generally comprised of a handle 12, a mouth template 14, and a nipple 16. Mouth template 14 is usually circular or elliptical, and nipple 16 may be any one of a variety of shapes. Mouth template 14 is often constructed of a hard plastic material, while nipple 16 is made of soft plastic or rubber. The template 14 is optional as many pacifiers consist only of a nipple and a handle. Handle 12 should be constructed of a semi-rigid material, having a form-defining resiliency. Handle 12 is generally thinner along one axis.

Figure 2:
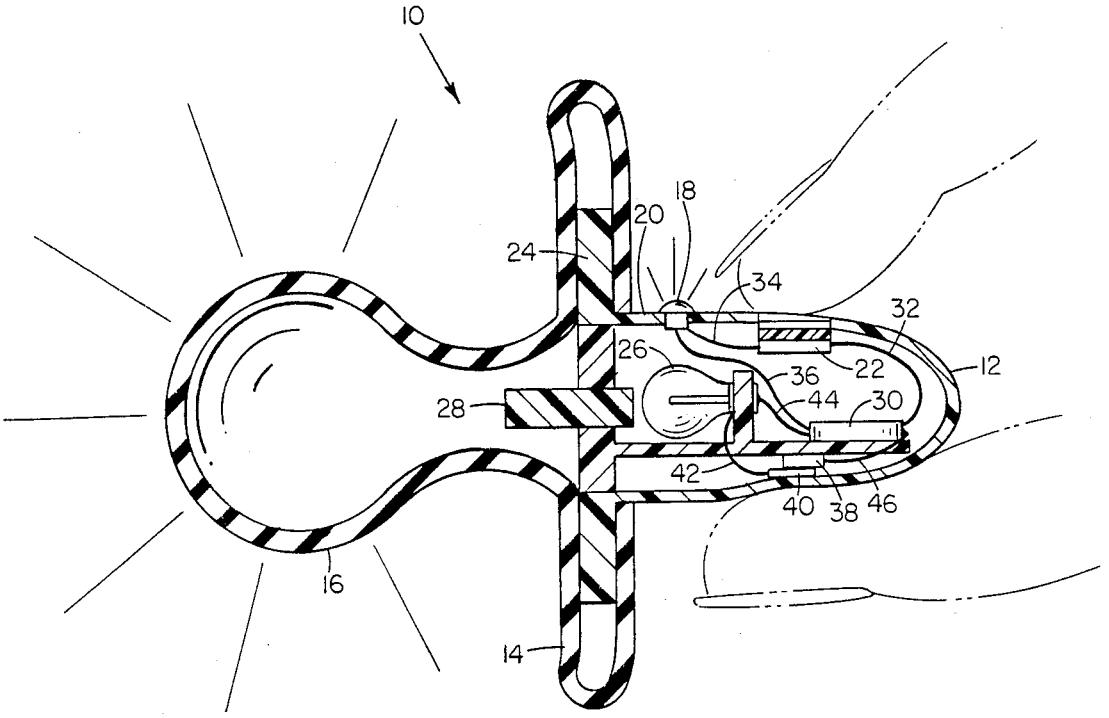
FIG. 2 is a cross-sectional side view of the present invention showing activation of the light bulb by squeezing the handle.

With further reference to FIG. 2, there is depicted the inner workings of illuminated pacifier 10. A low power light emitting diode (LED) 18 is located on the outer surface 20 of handle 12. LED 18 is activated by a rocker-type on/off switch 22, also located on outer surface 20. LED 18 is powered by a battery 30. Electrical leads 32, 34, and 36 connect the battery 30 to the switch 22 and LED 18.

A frame 24 reinforces mouth template 14 and extends into the inside of handle 12. The portion of frame 24 extending into handle 12 is essentially planar. Mounted on frame 24 is an incandescent light bulb 26, directed toward nipple 16. Interposed between light bulb 26 and nipple 16 is a light conducting rod 28, which aids in the transmission of the light from bulb 26 to nipple 16. Rod 28 is attached to frame 24 along a portion of its outer circumference. Nipple 16 is preferably translucent, to allow the light from bulb 26 to illuminate the baby's face. Light bulb 26 is preferably between 5 and 10 watts.

Light bulb 26 is activated by upper and lower contacts 38 and 40. Upper contact 38 is attached to the lower side of frame 24, and lower contact 40 is attached to the inner surface of handle 12. Battery 30 also powers light bulb 26. Electrical leads 42, 44, and 46 connect the battery to contacts 38 and 40, and to light bulb 26. In its relaxed state, the inner surface of handle 12 is slightly displaced away from frame 24, and upper and lower contacts 38 and 40 are not touching.

The illuminated pacifier 10 is intended to be used when putting the baby to sleep at night. The rocker switch 22 is turned on, making LED 18 begin to glow. The pacifier is then given to the baby, and the lights in the room may be turned off. Later at night, when it is time for the baby's feeding, or if the baby experiences some discomfort and wakes up, the parent may enter the room and, without turning on the lights, locate the pacifier 10 in the dark by means of glowing LED 18. Then, by squeezing handle 12, upper and lower contacts 38 and 40 come into electrical connection, turning on light bulb 26, and allowing pacifier 10 to be used as a flashlight in targeting the baby's mouth. When handle 12 is released, it returns to its undeformed state, disconnecting contacts 38 and 40, whereby light bulb 26 is automatically turned off, avoiding excess drainage of power from battery 30. LED 18 is also of a low-power type. Pacifier 10 is disposable so that it may conveniently be thrown away when battery 30 becomes dead.

Although the invention has been described with reference to specific embodiments, this description is not meant to be construed in the limiting sense. Various modifications of the disclosed embodiment, as well as alternative embodiments of the invention will become apparent to persons skill in the art upon reference to the description of the invention. It is therefore contemplated that the appended claims will cover such modifications that fall within the true scope of the invention.

I claim:

1. An illuminated pacifier comprising:

a nipple;

handle means attached to said nipple;

a low power light emitting diode attached to said handle means;

first switch means for selectively engaging said light emitting diode;

an incandescent light bulb located inside said handle means, directed toward said nipple;

second switch means for selectively engaging said incandescent light bulb, said second switch means actuatable by squeezing said handle means; and battery means for powering said light emitting diode and said incandescent light bulb, whereby said pacifier may be located in the dark and whereby said nipple may be illuminated by squeezing said handle means.

2. An illuminated pacifier as recited in claim 1 additionally comprising a light conducting rod mounted within said handle means, interposed between said nipple and said incandescent bulb, for aiding the transmission of light from said incandescent bulb to said nipple.

3. An illuminated pacifier comprising:

a translucent nipple;

a mouth template attached to said nipple;

a semi-rigid handle attached to said mouth template, said handle having an inner cavity, an inner surface, and an outer surface;

a frame attached to said mouth template, extending within said inner cavity of said handle;

a light emitting diode attached to said outer surface of said handle;

a rocker switch attached to said outer surface of said handle, for activating said light emitting diode;

an incandescent light bulb located in said inner cavity of said handle, said bulb attached to said frame, directed towards said nipple;

a light conducting rod attached to said frame, interposed between said nipple and said incandescent bulb;

a first contact attached to said frame;

a second contact attached to said inner surface of said handle, disposed between said inner-surface and said first contact, and slightly displaced from said first contact, whereby when said handle is squeezed said first and second contacts come into electrical connection, for activating said incandescent light bulb; and a battery located inside said handle, attached to said frame, for energizing said light emitting diode and said incandescent light bulb.

* * * * *